US008833558B2

(12) United States Patent
Chen et al.

(10) Patent No.: US 8,833,558 B2
(45) **Date of Patent: *Sep. 16, 2014**

(54) PACKAGING STRUCTURE OF LIQUID CRYSTAL GLASS PANEL

(71) Applicant: Shenzhen China Star Optoelectronics Technology Co., Ltd., Guangdong (CN)

(72) Inventors: Shihhsiang Chen, Shenzhen (CN); Yicheng Kuo, Shenzhen (CN); Jiahe Cheng, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 75 days.

This patent is subject to a terminal disclaimer.

(21) Appl. No.: 13/702,121

(22) PCT Filed: Oct. 11, 2012

(86) PCT No.: PCT/CN2012/082737

§ 371 (c)(1),
(2), (4) Date: Dec. 5, 2012

(87) PCT Pub. No.: WO2014/047968

PCT Pub. Date: Apr. 3, 2014

(65) Prior Publication Data

US 2014/0083898 A1 Mar. 27, 2014

(51) Int. Cl.

| | |
|---|---|
| ***B65D 85/48*** | (2006.01) |
| ***B65D 81/05*** | (2006.01) |
| ***B65D 81/07*** | (2006.01) |
| ***B65D 6/00*** | (2006.01) |
| ***B65D 81/107*** | (2006.01) |

(52) U.S. Cl.

CPC ..... *B65D 81/053* (2013.01); *B65D 11/10* (2013.01); *B65D 81/107* (2013.01); *B65D 85/48* (2013.01)

USPC ..... 206/454; 206/523; 206/586

(58) Field of Classification Search

USPC ..... 206/449, 454, 521, 523, 586–594

See application file for complete search history.

(56) References Cited

U.S. PATENT DOCUMENTS 3,701,465 A * 10/1972 Richter ..... 206/523
4,470,508 A * 9/1984 Yen ..... 206/454

(Continued)

FOREIGN PATENT DOCUMENTS

CN 2711086 Y 7/2005
CN 200946016 Y 9/2007

(Continued)

*Primary Examiner* — Bryon Gehman

(74) *Attorney, Agent, or Firm* — Andrew C. Cheng

(57) ABSTRACT

The present invention provides a liquid crystal glass panel packaging structure, which includes a package box and a plurality of cushioning members mounted inside the package box. The package box includes a lower case and an upper case mating the lower case. The lower case forms, on side walls thereof, mounting sections corresponding to the cushioning members and also forms a receiving channel below each of the mounting sections to correspond to the cushioning member. The cushioning members each form a mounting slot and projections. The mounting sections are each in the form of an arch bridge having a bridge floor forming mounting holes corresponding to the projections, whereby to set up, the mounting slot is fit to a side of the bridge floor and the projections are fit into the mounting holes to fix the cushioning member inside the lower case.

11 Claims, 5 Drawing Sheets

(56) References Cited

U.S. PATENT DOCUMENTS

| | | | | |
|---|---|---|---|---|
| 5,588,531 | A * | 12/1996 | Yoshida et al. | 206/454 |
| 5,904,251 | A * | 5/1999 | Ogata et al. | 206/454 |
| 7,059,473 | B2 * | 6/2006 | Watanabe et al. | 206/454 |
| 7,219,798 | B2 * | 5/2007 | Chen | 206/454 |
| 7,341,151 | B2 * | 3/2008 | Takagi | 206/454 |
| 2008/0128310 | A1 | 6/2008 | Kao | |
| 2013/0306514 | A1 * | 11/2013 | Hu et al. | 206/586 |

FOREIGN PATENT DOCUMENTS

| | | | |
|---|---|---|---|
| CN | 201128567 | Y | 10/2008 |
| CN | 101486404 | A | 7/2009 |
| CN | 102616488 | A | 8/2012 |
| KR | 20100129921 | A | 12/2010 |

* cited by examiner

PACKAGING STRUCTURE OF LIQUID CRYSTAL GLASS PANEL

BACKGROUND OF THE INVENTION

1. Field of the Invention

The present invention relates to the field of packaging of liquid crystal displaying, and in particular to a packaging structure of liquid crystal glass panel.

2. The Related Arts

In the field of manufacture of liquid crystal display devices, the manufacture of liquid crystal display devices includes a process of assembling, which puts various components, including a liquid crystal glass panel, a main control circuit, and an enclosure, together. These components are each manufactured in advance and packaged for being later assembled to form a complete liquid crystal display device. The liquid crystal glass panel, after being manufactured, is packaged in a liquid crystal glass panel package box and then shipped in box to a corresponding assembling station. Commonly used package boxes include paper boxes and plastic boxes. Plastic boxes have better structures and low costs, but they have poor cushioning property so that cushioning members must be additionally set up in the interior thereof to effect cushioning. Currently, fixing between the internal cushioning members and the package box is often done by double-sided adhesive tapes or PP plastic bonding agent, PE plastic bonding agent, PS plastic bonding agent, and PVC plastic bonding agent that are devoted to bond plastics.

A conventional liquid crystal glass panel packaging structure is illustrated in FIGS. 1 and 2 and comprises a lower case 100 and an upper case (not shown) that mate each other. A plurality of cushioning members 500 is provided inside the lower case 100 corresponding to edges of a liquid crystal glass panel 300. The lower case 100 comprises a mounting section 102 and the cushioning member 500 has one side that is fixed to the mounting section 102 by a double-sided adhesive tape. The lower case 100 also forms a recess 104 corresponding to a lower end of the cushioning member 500 so that the lower end of the cushioning member 500 is mounted in the recess 104 to complete the installation and fixation of the cushioning member 500 in the package of the liquid crystal glass panel 300.

However, this way of bonding the cushioning member and the package box of a liquid crystal glass panel package is of high cost, is not easy to remove, and is the not idea for repeated use so that the shipping cost is increased. Further, after a long term use, the adhesive may get inactive, making the cushioning member detached and falling thereby deteriorating the cushioning property of the box and leading to damage of the liquid crystal glass panel during transportation.

Thus, it is a challenge to the present inventor and those devoted themselves to the art to provide a solution for fixing a cushioning member in a liquid crystal glass panel package to provide excellent cushioning performance and also overcoming the problems of high cost, being not easy to remove, being not idea for repeated use, and cushioning member being detached and falling due to adhesive getting inactive after a long term use that are found in the solution adopted in the conventional liquid crystal glass panel package to fix a cushioning member in a liquid crystal glass panel package.

SUMMARY OF THE INVENTION

An object of the present invention is to provide a liquid crystal glass panel packaging structure, wherein a package box comprises therein a cushioning member that is fixed to an inside wall of the package box through snap-fitting, whereby such a way of coupling requires no additional assisting fixing material so as to save the transportation cost of the liquid crystal glass panel.

To achieve the object, the present invention provides a liquid crystal glass panel packaging structure, which comprises a package box and a plurality of cushioning members mounted inside the package box. The package box comprises a lower case and an upper case mating the lower case. The lower case forms, on side walls thereof, mounting sections corresponding to the cushioning members and also forms a receiving channel below each of the mounting sections to correspond to the cushioning member. The cushioning members each form a mounting slot and projections. The mounting sections are each in the form of an arch bridge having a bridge floor forming mounting holes corresponding to the projections, whereby to set up, the mounting slot is fit to a side of the bridge floor and the projections are fit into the mounting holes to fix the cushioning member inside the lower case.

The cushioning members each comprise a first cushioning section, a second cushioning section perpendicular to the first cushioning section, and a third cushioning section perpendicular to the second cushioning section. The first, second, and third cushioning sections collectively define an inverted U-shaped mounting slot.

The first cushioning section, the second cushioning section and the third cushioning section are integrally formed. The first cushioning section has a length smaller than that of the third cushioning section.

The cushioning members are mounted to the mounting sections with a lower end of each of the third cushioning sections received in the receiving channel.

The projections are formed in a middle portion of the third cushioning section. The projections are arranged to point toward the lower case.

The projections are cylindrical.

The mounting sections form cylindrical mounting holes corresponding to the cylindrical projections.

The projections have a diameter great than or equal to diameter of the mounting holes.

The upper case and the lower case are both made of plastics.

The cushioning members are made of a foamed cushioning material, corrugated paper, or a vacuum-formable material.

The present invention also provides a liquid crystal glass panel packaging structure, which comprises a package box and a plurality of cushioning members mounted inside the package box, the package box comprising a lower case and an upper case mating the lower case, the lower case forming, on side walls thereof, mounting sections corresponding to the cushioning members and also forming a receiving channel below each of the mounting sections to correspond to the cushioning member, the cushioning members each forming a mounting slot and projections, the mounting sections being each in the form of an arch bridge having a bridge floor forming mounting holes corresponding to the projections, whereby to set up, the mounting slot is fit to a side of the bridge floor and the projections are fit into the mounting holes to fix the cushioning member inside the lower case;

wherein the cushioning members each comprise a first cushioning section, a second cushioning section perpendicular to the first cushioning section, and a third cushioning section perpendicular to the second cushioning section, the first, second, and third cushioning sections collectively defining an inverted U-shaped mounting slot;

wherein the first cushioning section, the second cushioning section and the third cushioning section are integrally formed, the first cushioning section having a length smaller than that of the third cushioning section;

wherein the cushioning members are mounted to the mounting sections with a lower end of each of the third cushioning sections received in the receiving channel;

wherein the projections are formed in a middle portion of the third cushioning section, the projections being arranged to point toward the lower case;

wherein the projections are cylindrical;

wherein the mounting sections form cylindrical mounting holes corresponding to the cylindrical projections;

wherein the projections have a diameter great than or equal to diameter of the mounting holes;

wherein the upper case and the lower case are both made of plastics; and wherein the cushioning members are made of a foamed cushioning material, corrugated paper, or a vacuum-formable material.

The efficacy of the present invention is that the present invention provides a liquid crystal glass panel packaging structure, which comprises a package box comprising therein cushioning members that are mounted to inside walls of the package box through snap fitting that requires no using additional assisting fixing material, is easy to remove and repeatedly usable, and thus reduces the transportation cost of liquid crystal glass panels and may improve the quality of the package box to avoid quality issue of the liquid crystal glass panels caused by the cushioning members being detached.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
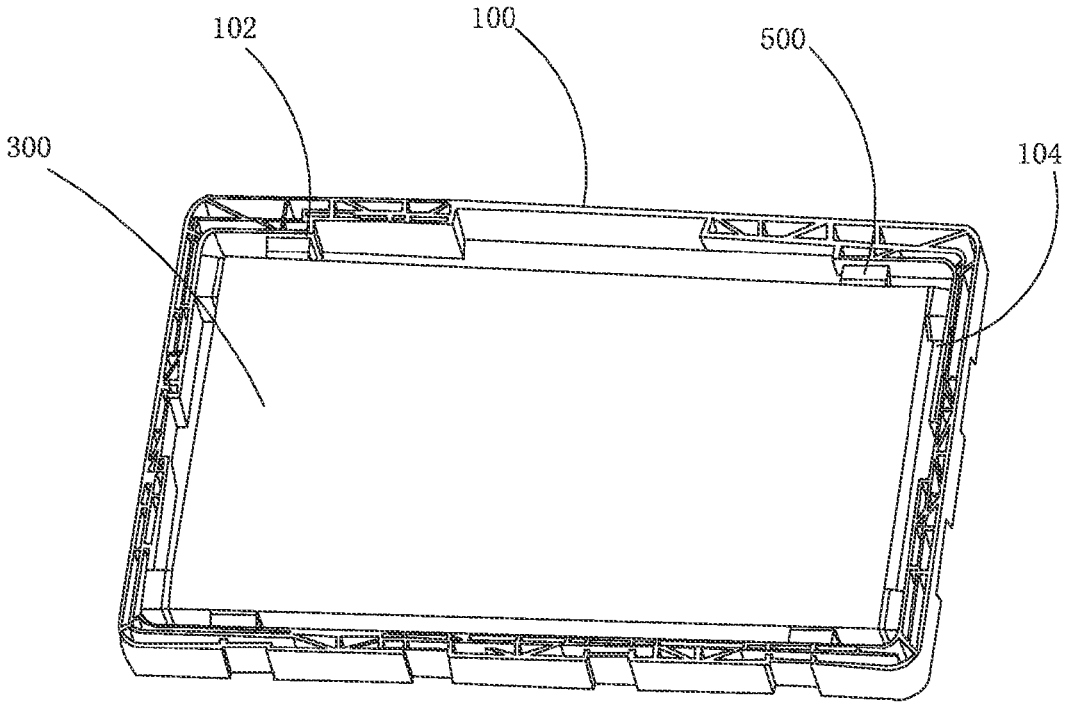
FIG. 1 is a schematic view illustrating a conventional packaging structure of liquid crystal glass panel.
Figure 2:
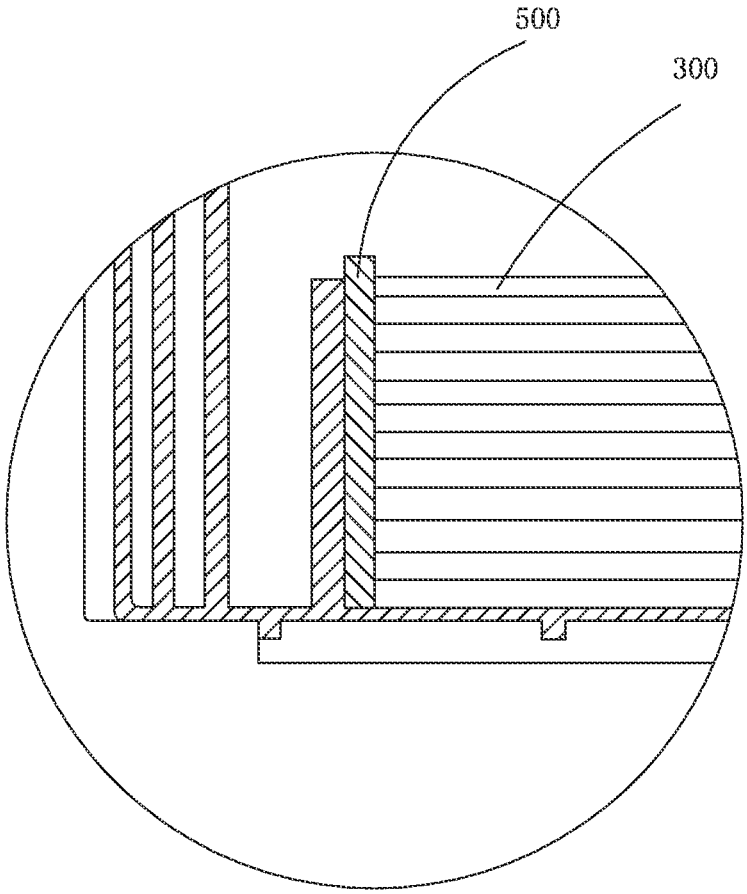
FIG. 2 is a partial cross-sectional view of a lower case of FIG. 1.
Figure 3:
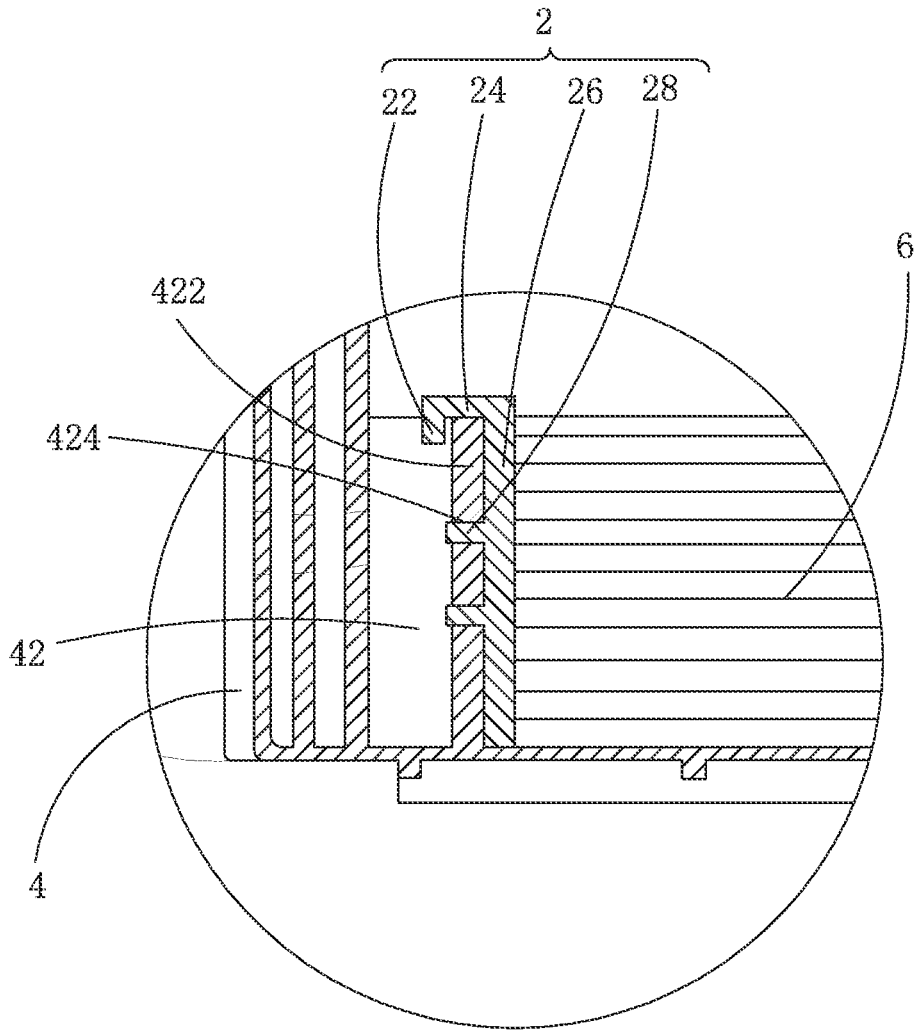
FIG. 3 is a partial cross-sectional view of a lower case of liquid crystal glass panel packaging structure according to the present invention.
Figure 4:
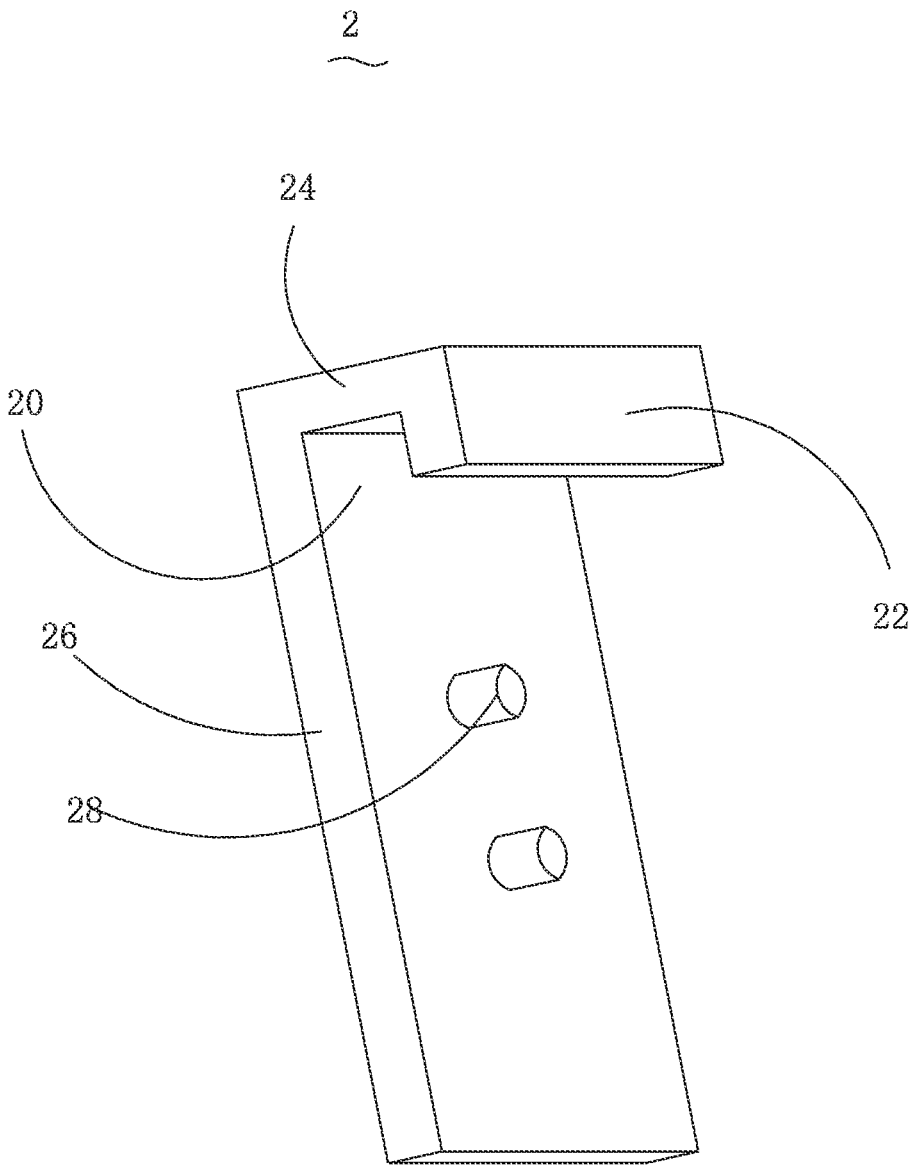
FIG. 4 is a perspective view of a cushioning member of FIG. 3.
Figure 5:
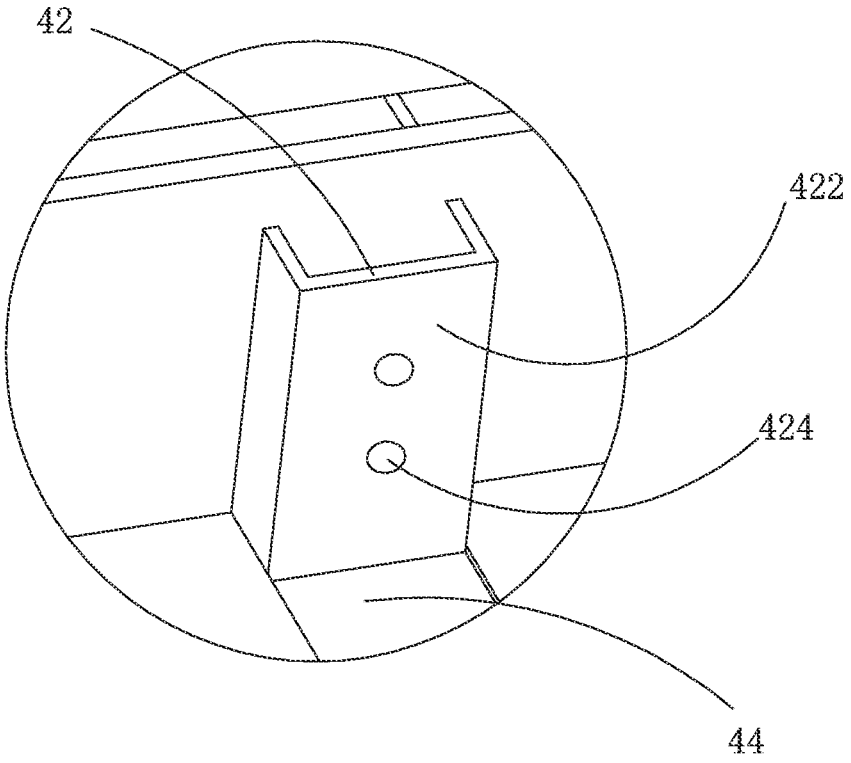
FIG. 5 is a perspective view of a mounting section of the lower case of FIG. 3.

Referring to FIGS. 3-5, the present invention provides a liquid crystal glass panel packaging structure, which comprises a package box (not shown) and a plurality of cushioning members 2 mounted inside the package box. The package box comprises a lower case 4 and an upper case (not shown) mating the lower case 4. The upper case and the lower case 4 are both made of plastics. Cases made of plastics are of better structures than ordinary cartons or paper boxes and are repeatedly usable without breaking and are resistant to humidity and water so that better protection can be provided. Further, repeated use of the package box allows of reduction of packaging cost.

The lower case 4 forms, on side walls thereof, a plurality of mounting sections 42 corresponding to the cushioning members 2. The cushioning members 2 are respectively mounted to the mounting sections 42 to cushion liquid crystal glass panels 6 received in the lower case 4.

The cushioning members 2 are each integrally formed of foamed cushioning materials, corrugated paper, or vacuum-formable materials and comprise a first cushioning section 22, a second cushioning section 24 perpendicular to the first cushioning section 22, and a third cushioning section 26 perpendicular to the second cushioning section 24. The cushioning members 2 each form a mounting slot 20 and projections 28. The mounting slot 20 is defined by the first, second, and third cushioning sections 22, 24, 26. Preferably, the first cushioning section 22 has a length smaller than that of the third cushioning section 26 to facilitate mounting and removal. The projections 28 are arranged to point toward the mounting sections 42. Preferably, the projections 28 are formed at a middle portion of the third cushioning section 26 and the projections 28 are set in the form of cylinder.

The mounting sections 42 are each set in the form of an arch bridge, which has a bridge floor 422 forming mounting holes 424 corresponding to the projections 28. The mounting holes 424 are arranged as cylindrical mounting holes 424 to correspond to the cylindrical projections 28. The projections 28 have a diameter that is greater than or equal to diameter of the mounting holes 424 in order to form interference fitting thereby ensuring the fixation of the cushioning members 2. The projections 28, being integrally formed of foamed cushioning materials, corrugated paper, or vacuum-formable materials, show certain elasticity so that the mounting/removal thereof to/from the mounting holes 424 is made easy and repeated use can be achieved and thus favorable for cost control.

Preferably, the lower case 4 forms a receiving channel 44 below the mounting section 42 to correspond the cushioning member 2 and the cushioning member 2 is mounted to the mounting section 42 in such a way that a lower end of the third cushioning section 26 is received in the receiving channel 44.

To set up, the mounting slot 20 is fit over a side of the bridge floor 422 and then, with the side of the bridge floor 422 as a rotation axis, the third cushioning section 26 is rotated toward the bridge floor 422 until the projections 28 are respectively fit into the mounting holes 424 thereby mounting and fixing the cushioning member 2 inside the lower case 4.

In transportation, the mounting slot 20 being fit over the side of the bridge floor 422 effectively prevent horizontal displacement caused by an external force acting in a horizontal direction due to acceleration or abrupt stop of a vehicle thereby effectively protecting the liquid crystal glass panels 6 received in the package box.

In transportation, the projections 28 being fit into the mounting holes 424 effectively prevent vertical displacement caused by an external force acting in a vertical direction due to acceleration or abrupt stop of a vehicle thereby effectively protecting the liquid crystal glass panels 6 received in the package box.

In summary, the present invention provides a liquid crystal glass panel packaging structure, which comprises a package box comprising therein cushioning members that are mounted to inside walls of the package box through snap fitting that requires no using additional assisting fixing material, is easy to remove and repeatedly usable, and thus reduces the transportation cost of liquid crystal glass panels and may improve the quality of the package box to avoid quality issue of the liquid crystal glass panels caused by the cushioning members being detached.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal glass panel packaging structure, comprising a package box and a plurality of cushioning members mounted inside the package box, the package box comprising a lower case and an upper case mated to the lower case, the lower case forming, on side walls thereof, mounting sections corresponding to the cushioning members and also forming a receiving channel below each of the mounting sections, the cushioning members each forming a mounting slot and projections, the mounting sections being each in the form of an arch bridge having a bridge floor forming mounting holes corresponding to the projections, whereby to set up, the mounting slot is fit to a side of the bridge floor and the projections are fit into the mounting holes to fix the cushioning member inside the lower case.

2. The liquid crystal glass panel packaging structure as claimed in claim 1, wherein the cushioning members each comprise a first cushioning section, a second cushioning section perpendicular to the first cushioning section, and a third cushioning section perpendicular to the second cushioning section, the first, second, and third cushioning sections collectively defining an inverted U-shaped mounting slot.

3. The liquid crystal glass panel packaging structure as claimed in claim 2, wherein the first cushioning section, the second cushioning section and the third cushioning section are integrally formed, the first cushioning section having a length smaller than that of the third cushioning section.

4. The liquid crystal glass panel packaging structure as claimed in claim 2, wherein the cushioning members are mounted to the mounting sections with a lower end of each of the third cushioning sections received in the receiving channel.

5. The liquid crystal glass panel packaging structure as claimed in claim 2, wherein the projections are formed in a middle portion of the third cushioning section, the projections being arranged to point toward the lower case.

6. The liquid crystal glass panel packaging structure as claimed in claim 5, wherein the projections are cylindrical.

7. The liquid crystal glass panel packaging structure as claimed in claim 6, wherein the mounting holes of the mounting sections are cylindrical corresponding to the cylindrical projections.

8. The liquid crystal glass panel packaging structure as claimed in claim 7, wherein the projections have a diameter greater than a diameter of the mounting holes, whereby the projections are received in the mounting holes through interference fitting.

9. The liquid crystal glass panel packaging structure as claimed in claim 1, wherein the upper case and the lower case are both made of plastics.

10. The liquid crystal glass panel packaging structure as claimed in claim 1, wherein the cushioning members are made of one of a foamed cushioning material, corrugated paper, and a vacuum-formable material.

11. A liquid crystal glass panel packaging structure, comprising a package box and a plurality of cushioning members mounted inside the package box, the package box comprising a lower case and an upper case mated to the lower case, the lower case forming, on side walls thereof, mounting sections corresponding to the cushioning members and also forming a receiving channel below each of the mounting sections, the cushioning members each forming a mounting slot and projections, the mounting sections being each in the form of an arch bridge having a bridge floor forming mounting holes corresponding to the projections, whereby to set up, the mounting slot is fit to a side of the bridge floor and the projections are fit into the mounting holes to fix the cushioning member inside the lower case;

wherein the cushioning members each comprise a first cushioning section, a second cushioning section perpendicular to the first cushioning section, and a third cushioning section perpendicular to the second cushioning section, the first, second, and third cushioning sections collectively defining an inverted U-shaped mounting slot;

wherein the first cushioning section, the second cushioning section and the third cushioning section are integrally formed, the first cushioning section having a length smaller than that of the third cushioning section;

wherein the cushioning members are mounted to the mounting sections with a lower end of each of the third cushioning sections received in the receiving channel;

wherein the projections are formed in a middle portion of the third cushioning section, the projections being arranged to point toward the lower case;

wherein the projections are cylindrical;

wherein the mounting holes of the mounting sections are cylindrical corresponding to the cylindrical projections;

wherein the projections have a diameter greater than a diameter of the mounting holes, whereby the projections are received in the mounting holes through interference fitting;

wherein the upper case and the lower case are both made of plastics; and wherein the cushioning members are made of one of a foamed cushioning material, corrugated paper, and a vacuum-formable material.

* * * * *